US006214058B1

(12) United States Patent
Kent et al.

(10) Patent No.: US 6,214,058 B1
(45) Date of Patent: Apr. 10, 2001

(54) COMFORT MELAMINE FABRICS AND PROCESS FOR MAKING THEM

(75) Inventors: George M. Kent, Arden; Dean R. Gadoury; Dominick A. Burlone, both of Asheville; Karen L. Johnson, Charlotte, all of NC (US)

(73) Assignee: BASF Corporation, Mt. Olive, NJ (US)

( * ) Notice: Subject to any disclaimer, the term of this patent is extended or adjusted under 35 U.S.C. 154(b) by 0 days.

(21) Appl. No.: 09/003,991

(22) Filed: Jan. 8, 1998

Related U.S. Application Data

(63) Continuation of application No. 08/845,555, filed on Apr. 24, 1997, now Pat. No. 5,849,648.

(51) Int. Cl.[7] ..... D06Q 1/02

(52) U.S. Cl. ..... 8/115.51; 8/137; 8/529; 8/115.7

(58) Field of Search ..... 8/115.51, 137, 8/529, 115.7

(56) References Cited

U.S. PATENT DOCUMENTS

| | | | | |
|---|---|---|---|---|
| Re. 30,860 | | 2/1982 | Swidler et al. | 8/116.4 |
| 4,001,477 | | 1/1977 | Economy et al. | 428/224 |
| 4,088,620 | | 5/1978 | Nihongi et al. | 260/29.4 |
| 4,179,391 | * | 12/1979 | Kaufmann et al. | 252/99 |
| 4,207,068 | | 6/1980 | Blanchard et al. | 8/493 |
| 4,406,660 | | 9/1983 | Beiner et al. | 604/376 |
| 4,558,097 | | 12/1985 | Lofquist et al. | 525/183 |
| 5,051,110 | | 9/1991 | Borrell et al. | 8/115.66 |
| 5,496,625 | | 3/1996 | Lilani | 428/229 |
| 5,530,031 | | 6/1996 | Guenther et al. | 521/495 |
| 5,560,990 | | 10/1996 | Ilg et al. | 428/362 |
| 5,624,466 | | 4/1997 | Schindler et al. | 8/506 |

FOREIGN PATENT DOCUMENTS

4432833 A1 * 3/1996 (DE) .

OTHER PUBLICATIONS

Joseph, Marjory L. "Introductory Textile Science", Fifth Edition, p. 335.

* cited by examiner

*Primary Examiner*—Elizabeth M. Cole
(74) *Attorney, Agent, or Firm*—Nixon & Vanderhye P.C.

(57) ABSTRACT

Fabrics made of melamine fibers are made more comfortable by submerging them for at least 20 minutes in a dyebath or mock dyebath that is at least 70° C.

11 Claims, No Drawings

COMFORT MELAMINE FABRICS AND PROCESS FOR MAKING THEM

This is a continuation application of copending U.S. patent application Ser. No. 08/845,555 filed Apr. 24, 1997 now U.S. Pat. No. 5,849,648, the content of which is hereby incorporated herein by reference.

FIELD OF THE INVENTION

The present invention relates to fabrics and yarns made from melamine fibers and processes for imparting physical characteristics, such as color, moisture regain and improved hand to them.

BACKGROUND OF THE INVENTION

Melamine fibers are useful in applications requiring resistance to heat and flame. Examples of such applications include upholstery, drapery material, fire fighting apparel, etc. Such applications might be considered so utilitarian because of their role in preserving life and property that appearance is a minor secondary consideration. This is not true, however, and style plays an important part of fabric selection. Therefore, it is important that the fabrics made with melamine be dyeable to desired shades. Because the chemistry of the melamine fiber is different than the more commonplace man-made synthetic fibers, the dyestuffs known to dye these more common fibers do not necessarily dye melamine fibers. As a result, there is a need to find dyestuffs and conditions that will dye the melamine fabrics.

Many melamine fabrics in their natural state may have a harsh or itchy hand. In certain applications of melamine fabrics, this characteristic is viewed as a drawback to using melamine fabrics even when the protective performance is superior. Methods to increase the comfort and improve the hand of melamine fabrics are desirable.

Comfort may also be linked to "moisture regain" so that for some fabrics, one method for improving comfort is to increase "moisture regain". It is believed that the ability of a synthetic fiber to absorb moisture makes such fibers more like cotton and less synthetic feeling against the skin. Moisture regain refers to the characteristic of fabrics to absorb moisture. Cotton fabrics, which are traditionally viewed as comfort fabrics, have relatively high moisture regain properties (typically in the range of about 8.5 to about 10.5) which allows wicking action to remove moisture from the skin resulting in a comfortable "feel".

Softness is an attribute of hand that some consider to defy quantitation. However, when manually comparing the softness of two different fabrics, there is general agreement on which one is softer.

Melamine fibers are often blended with other fibers such that most melamine fabrics are actually blends of melamine and other types of fiber. Melamine fibers are blended with a large variety of fibers, for example, p-aramids, m-aramids, glass, flame resistant (FR) cellulosic fibers, steel cotton, wool polyester, etc. The same concerns of dyeability and hand apply to fabrics made from blends of melamine fibers and other fibers as apply to all melamine fabrics. Methods for dyeing these fabrics and also improving the hand are desirable.

In addition, novel color effects are sought in the industry. Dyeing methods that cause unique or attractive appearances in the fabric subjected to the method are considered beneficial. One popular color effect is called "chambray". Chambray fabrics are exemplified by worn denim jeans. Usually, this effect is accomplished by process steps, e.g., stone washing, after the dyeing process. In addition, the denim effect is usually achievable with dyes that do not exhibit good washfastness to cellulosic materials combined with the use of undyed warp yarns in the starting fabric. Upon washing, certain dyes exhibit poor fastness to washing resulting in a lighter appearance and more noticeable uncolored warp yarns.

SUMMARY OF THE INVENTION

It is an object of the present invention to provide a method for dyeing melamine fabrics.

It is another object of the present invention to provide a dyed melamine fiber fabric.

It is a further object of the present invention to provide a method for dyeing melamine fiber blend fabrics.

It is a still further object of the present invention to provide a dyed melamine fiber blend fabric.

It is yet another object of the present invention to provide a method to improve the hand of melamine fiber and melamine fiber blend fabrics.

It is still another object of the present invention to provide a melamine or melamine blend fabric with good hand characteristics.

These and related objects and advantages are achieved with a process for improving the comfort of fabrics made from melamine fibers by submerging the fabrics in an aqueous bath heated to more than 70° C. for more than 20 minutes. The aqueous bath may be substantially all water or it may be a dyebath. The aqueous bath may contain one or more solutes selected from leveling agents; dispersing agents; chelating agents; lubricating agents; pH adjustment agents; and combinations thereof. The bath is preferably heated to a temperature from about 90° C. to about 130° C. The fabric may comprise a blend of melamine fibers and other fibers. The melamine fibers are preferably melamine-formaldehyde fibers comprising the condensation product of melamine and formaldehyde in a molar ratio of two moles of formaldehyde to one mole melamine and containing hydroxyoxaalkylmelamines and, optionally, other additives in small amounts.

The present invention also includes a process for improving the comfort of fabrics made from melamine fibers by submerging the fabrics in an aqueous bath at a temperature and for a time such that the moisture regain of the melamine fiber in the fabric after said submerging is greater than about 6.5% by weight and preferably greater than about 7% by weight.

Another aspect of the present invention is a fabric comprising melamine fibers having a moisture regain of greater than about 6.5% by weight and preferably greater than at least about 7% by weight of the melamine fiber in the fabric. The fabric may be dyed. It may be composed of melamine fibers and other fibers.

Related objects and advantages of the present invention will be apparent to those of ordinary skill in the art after reading the following detailed description.

DETAILED DESCRIPTION OF THE PREFERRED EMBODIMENTS

To promote an understanding of the principles of the present invention, descriptions of specific embodiments of the invention follow and specific language is used to describe the same. It will be understood that no limitation of the scope of the invention is intended by the use of this specific language and that alterations, modifications, equivalents and further applications of the principles of the invention discussed are contemplated as would normally occur to one ordinarily skilled in the art to which the invention pertains.

The following detailed description of the present invention refers to dyeing articles in the form of fabrics, yarns, etc. It is believed that there is no limitation of the particular form the article may take, i.e., it may be in fabric, yarn, web, thread, fiber, sliver, tow, etc., form. The invention relates to standard methods for imparting color to fiber in all of these constructions, e.g., dyeing, printing, etc. Preferably, the process is a dyeing process. The dyeing process may be in an aqueous or non-aqueous bath. Currently, an aqueous bath is preferred.

The melamine fiber may be used alone or it may be blended with another fiber to make a mixed component yarn. All-melamine fiber yarns may be made into fabrics without other types of fibers or with other types of fibers, etc. The terms "fabric" and "yarn" and "fiber" should be considered interchangeable and given their broadest interpretation consistent with the art for the purposes of the present invention.

For the purposes of describing the dyeing effects achieved with the present invention, the terms "dyed" (and related words) and "stained" (and related words) are used to describe different responses to a particular dyestuff. These terms are used in accordance with the general meaning given to them by those who are ordinarily skilled in this art.

The present invention concerns dyed heat and flame resistant fabrics. In general, such fabrics as used in this context are those having a limiting oxygen index of greater than about 28 as measured by ASDM D-2863-77, more preferably at least 30.

I. DYED FABRICS (AND YARNS) FROM MELAMINE FIBERS AND BLENDS THEREOF (MELAMINE DYED)

One aspect of the present invention is a process for dyeing an article constructed from at least a fraction of heat and flame resistant melamine fiber. The article to be dyed is placed for about 30 to about 120 minutes in a dyebath containing a dye or blend of dyes that is heated to at least about 95° C. to about 150° C. This aspect of the present invention and articles made thereby are illustrated in Exanples 1–6.

The article may be composed of 100% melamine fiber or it may be a blend of melamine with other fibers selected from: m-aramid fibers, p-aramid fibers, glass fibers, carbon fibers, other mineral or ceramic fibers, steel fibers, polybenzimidazole fibers, polyimide fibers, polyamide-imide fibers, polytetraflouroethylene fibers, polyetheretherketone fibers, polyacrylate fibers, polyaryletherketone fibers, novoloid fibers, polyethersulfone fibers, poly(vinyl chloride), poly (vinylidene chloride) fibers, liquid crystalline polyester fibers, and blends and combinations of these.

Further, the process of the present invention can be used to dye melamine fibers that are blended with other fibers that are precolored. Example 2 below demonstrates the process of the present invention resulting in an even coloring of fabric that is a 60:40 blend of p-aramid fibers and melamine fibers where the p-aramid fibers were pigmented (sometimes called "producer-colored") black.

The fabric may be in any form: woven, nonwoven, knitted, etc. If the fabric is a blend of melamine with other fibers, the blend level may be from about 20% to nearly 100% melamine fiber by weight. Preferably, the amount of melamine fiber in the blend will be no more than about 60% by weight.

The melamine fiber may be any melamine fiber, but is preferably a melamine-formaldehyde fiber that is essentially the condensation product of melamine and formaldehyde in a molar ratio of two moles of formaldehyde to one mole of melamine and containing hydroxyoxaalkylmelamines and, possibly, other additives in small amounts. One suitable melamine fiber is Basofil® fiber available from BASF Corporation, Mt. Olive, N.J.

The dyestuff in the dye bath is one or more of the following types of dyes: direct dyes, non-metallized acid dyes, metallized acid dyes, disperse dyes (without carriers) and blends thereof. Other materials may be present in the dyebath according to conventional dyeing practice. These materials include, for example, leveling agents, anti-foaming agents, dispersing agents, lubricating agents and chelating agents and combinations of these.

The temperature of the dyebath is in the range of about 95° C. to about 150° C., preferably about 110° C. to about 150° C. in the case of disperse dyes. The precise temperature will depend on the dyestuff used and should be readily determinable by those of ordinary skill in the art.

The fabric will be exposed to the dyebath for a period of time that will also depend on the dyestuff and will be readily determinable by those of ordinary skill in the art. Typical times range from about 30 to about 120 minutes.

After the dyeing step is complete and the fabric or yarn is dyed to the desired shade, typical, optional, subsequent steps may be used. For example, after scouring may be used if desired for a particular result.

Surprisingly, it was discovered that when the fabric is a blend of melamine fibers with one of the other types of fibers listed above, a unique chambray appearance resulted in the dyed fabric without any subsequent process steps (e.g., stone-washing) that are often used to enhance a chambray effect. Surprisingly, the melamine fiber is dyed but the other fiber is not dyed to a significant degree (although in some cases, it may stain slightly). The fabric, therefore, exhibits a chambray appearance without further process steps. It was especially notable when other non-melamine heat and flame resistant fibers that are non-dyeable, i.e., that do not dye to a deep shade (if at all) under the dyebath conditions that are present.

Another related aspect of the present invention is a dyed melamine or melamine blend fabric. This fabric may be made according to the above process and will preferably be made from a blend of melamine fibers with other fibers.

The present invention includes a process for dyeing an article constructed from heat and flame resistant melamine fiber and protein fibers. The melamine and protein article to be dyed is placed for about 30 to about 120 minutes in a dyebath containing a disperse dye or dyes that is heated to at least about 95° C. to about 110° C.

The article is a blend of melamine fibers with protein (or animal) fibers selected from: wool, silk, cashmere, mohair, rabbit, etc.) and blends and combinations of these with each other or with other types of fibers. The blend may contain from about 20% to nearly 100% melamine fibers by weight.

As noted, the dye preferably used is one ore more disperse dyes and blend thereof. Other materials may be present in the dyebath according to conventional dyeing practice. These materials include, for example, leveling agents, anti-foaming agents, dispersing agents, lubricating agents and chelating agents and combinations of these.

The temperature of the dyebath is preferably in the range of about 95° C. to about 110° C. The precise temperature will depend on the dyestuff used and should be readily determinable by those of ordinary skill in the art.

The fabric will be exposed to the dyebath for a period of time that will also depend on the dyestuff and will be readily determinable by those of ordinary skill in the art. Typical times range from about 30 to about 120 minutes.

After the dyeing step is complete and the fabric or yarn is dyed to the desired shade, typical, optional, subsequent steps may be used. For example, after scouring may be used if desired for a particular result.

Surprisingly, the blend of melamine fibers with one or more protein fibers exhibits a unique chambray appearance when dyed with disperse dyes (no carrier). No subsequent process steps were required. By way of illustration, Examples 6A–6B below describe the dyeing of a melamine/wool blend fabric with a disperse dye wherein the wool does not dye to any significant degree (although it may stain slightly), and the fabric exhibits a pleasing chambray appearance.

Another related aspect of the present invention is a dyed melamine fiber/protein fiber blend fabric. This fabric may be made according to the above process for dyeing melamine fiber blends and exhibits a chambray appearance.

II. DYED FABRICS (AND YARNS) FROM BLENDS OF MELAMINE FIBERS AND CELLULOSIC FIBERS (CELLULOSE DYED)

Another aspect of the present invention is a process for dyeing articles that are composed of melamine fibers and cellulosic fibers. This process provides such articles to an aqueous dyebath where it is dyed at a temperature of less than about 95° C. It is not necessary to weave the fabric using one fiber type as a warp and the other as the weft (as with denim fabrics) to obtain this result. This aspect of the invention and the fabrics made thereby are illustrated in Examples 7A–7F.

Exemplary cellulosic fibers are natural and synthetic cellulosic fibers such as cotton fibers, rayon fibers, bast fibers, leaf fibers, cellulose acetate fibers and blends thereof. These fibers may or may not be flame retardant ("FR") from treatments thereto that are known for the fiber type.

The melamine fiber may be any melamine fiber but is preferably a melamine formaldehyde fiber that is essentially the condensation product of melamine and formaldehyde in a molar ratio of two moles of formaldehyde to one mole of melamine and containing hydroxyoxaalkylmelamines and other additives in small amounts. One suitable melamine fiber is Basofil® fiber available from BASF Corporation, Mt. Olive, N.J.

The dyestuff is selected from the group of direct dyes, azoic dyes, reactive dyes, vat dyes, sulfur dyes, napthol dyes, disperse dyes in the case of acetates, and blends thereof. The preferable dyestuff will depend on the particular type (or types) of cellulosic fiber used. Other materials may be present in the dyebath according to conventional practice. For example, to dye cotton fibers with direct dyes, salt (such as Glauber's Salt) is usually required.

The fabric may be in any form, woven, nonwoven or knitted. It may contain between about 20% and nearly 100%, preferably, between about 20% and about 80%, melamine fiber by weight. Where the cellulosic fiber is FR cotton, the preferred amount of melamine in the fabric or yarn is about 20% to about 50% by weight. Other types of fibers may also be present.

Predyeing steps, such as scouring, bleaching, mercerizing, etc., may be used as desired. For dyeing, the temperature of the dyebath will be less than about 95° C., but the precise temperature will depend on the particular dyestuff used and will be readily determinable by those of ordinary skill in the art.

The fabric should be exposed to the dye long enough for the fabric to dye to the desired shade. The amount of time will depend on the exact composition of the fabric and will be readily determinable by those ordinarily skilled in the art.

Following dyeing, typical aftertreatments may be used as are presently known to those of ordinary skill in the art or are hereafter developed. These steps depend on the specific dyestuff or blend of dyestuffs used and include, for example, after-scouring, oxidation and neutralization.

Another aspect of the present invention is a heat and flame resistant chambray fabric that contains from about 20% to nearly 100% melamine fibers by weight that are substantially undyed (although they could be precolored during the fiber making process). In addition to the melamine fiber, the fabric contains cellulosic fibers selected from cotton fibers, rayon fibers, bast fibers, leaf fibers, cellulose acetate fibers and blends thereof with each other or other fibers. The cellulosic fibers are dyed with dyes selected from direct dyes, non-metallized acid dyes, reactive dyes, napthol dyes, vat dyes, sulfur dyes, azoic dyes, disperse dyes (for acetates), and blends thereof.

III. DYED FABRICS (AND YARNS) FROM BLENDS OF MELAMINE FIBER AND CELLULOSIC FIBER (MELAMINE DYED)

Another aspect of the present invention is a process for dyeing articles that are composed of melamine fibers and cellulosic fibers wherein the melamine fiber is dyed. This process provides such fabrics to an aqueous dyebath where it is dyed at a temperature exceeding about 95° C. Surprisingly, the melamine fiber is dyed but the cellulosic fiber is not substantially dyed (it may be stained) so that the fabric exhibits a chambray appearance without further process steps. It is not necessary to weave the fabric using one fiber type as a warp and the other as the weft (as with denim fabrics) to obtain this result. This aspect of the invention and the fabrics made thereby are illustrated in Examples 8A–8D.

Exemplary cellulosic fibers are natural and synthetic cellulosic fibers such as cotton fibers, rayon fibers, bast fibers, leaf fibers, and blends thereof with each other and with other fibers. These fibers may or may not be flame retardant (FR) from treatments thereto that are known for the fiber type.

The melamine fiber may be any melamine fiber but is preferably a melamine formaldehyde fiber that is essentially the condensation product of melamine and formaldehyde in a molar ratio of two moles of formaldehyde to one mole of melamine and containing hydroxyoxaalkylmelamines and, possibly, other additives in small amounts. One suitable melamine fiber is Basofil® fiber available from BASF Corporation, Mt. Olive, N.J.

The dyestuff is selected from the group of direct dyes (without salt, e.g., Glauber's Salt), metallized acid dyes, non-metallized acid dyes, disperse dyes, and blends thereof. Other materials may be present in the dyebath according to conventional practice.

A fabric may be in any form, woven, nonwoven or knitted. It may contain between about 20% and nearly 100% by weight, preferably, between about 20% and about 80%, melamine fiber by weight. Where the cellulosic fiber is FR cotton, the preferred amount of melamine in the fabric or yarn is about 20% to about 50% by weight.

Predyeing steps, such as scouring, bleaching, mercerizing, etc., may be used as desired. For dyeing, the temperature of the dyebath will be from at least about 95° C. to about 150° C., but the precise temperature will depend on the particular dyestuff used and will be readily determinable by those of ordinary skill in the art.

The fabric should be exposed to the dye long enough for the fabric to dye to the desired shade. The amount of time will depend on the exact composition of the fabric and will be readily determinable by those ordinarily skilled in the art.

Following dyeing, typical aftertreatments may be used as are presently known to those of ordinary skill in the art or are hereafter developed. These steps depend on the specific dyestuff or blend of dyestuffs used and include, for example, after scouring.

Another aspect of the present invention is a heat and flame resistant chambray article that contains from about 20% to nearly 100% melamine fibers by weight. The melamine fibers are dyed with direct dyes (without using salt), disperse dyes, non-metallized acid dyes or metallized acid dyes, or blends thereof. In addition to the melamine fiber, the fabric contains cellulosic fibers selected from cotton fibers, rayon fibers, bast fibers, leaf fibers, and blends thereof. The cellulosic fibers are substantially not dyed (but may be stained) by the direct dye, non-metallized acid dye, or metallized acid dye used to dye the melamine fiber.

IV. DYED FABRICS (AND YARNS) FROM BLENDS OF MELAMINE FIBER AND ARAMID FIBER (ARAMID DYED)

A further aspect of the present invention is a process for dyeing an article constructed from a blend of heat and flame resistant melamine fiber and aramid fiber wherein the aramid fiber is dyed but the melamine fiber is not substantially dyed. The article to be dyed is placed for about 30 to about 120 minutes in a dyebath containing a basic dye or blend of dyes, sodium nitrate and a carrier. The dyebath is heated to at least about 100° C. to about 190° C. (or more). This aspect of the present invention and fabrics made thereby are illustrated in Examples 11A–11C.

The fabric (or yarn) is composed of melamine with other fibers selected from m-aramid fibers and p-aramid fibers.

The fabric may be in any form: woven, nonwoven, knitted, etc. The blend level may be from about 20% to nearly 100% melamine fiber by weight. Preferably, the amount of melamine fiber in the blend will be no more than about 60% by weight. Other fiber types could also be present.

The melamine fiber may be any melamine fiber, but is preferably a melamine-formaldehyde fiber that is essentially the condensation product of melamine and formaldehyde in a molar ratio of two moles of formaldehyde to one mole of melamine and containing hydroxyoxaalkylmelamines and, possibly, other additives in small amounts. One suitable melamine fiber is Basofil® fiber available from BASF Corporation, Mt Olive, N.J.

The dye in the dye bath is one or more basic dyes. Sodium nitrate (or equivalent) and a carrier are also present. Suitable carriers include acetophenone; methyl benzoate; benzaldehyde; benzyl alcohol; benzyl alcohol/acetophenone mixtures; cyclohexanone; N-cyclohexyl-2-pyrrolidone; N-octyl pyrrolidone; N,N-diethyl (meta-toluamide); N,N-dimethylformamide; mixtures of N-butyl and N-isopropyl phthalimide; aryl ethers; and benzamides and dimethylamides. Examples of these include Polydyol NN; C-Prodye NM; Cadra NEX; Dymex; and Cindye NMX. Swelling agents such as N-methyl-2-pyrrolidone; N,N-dimethylacetamide; dimethylsulfoxide; and N,N-dimethylformamides may also be used.

Other materials may also be present in the dyebath according to conventional dyeing practice. These materials include, for example, leveling agents, anti-foaming agents, dispersing agents, lubricating agents and chelating agents and combinations of these.

The temperature of the dyebath is in the range of about 100° C. to about 190° C. (or more), and preferably at least about 120° C. The precise temperature will depend on the dyestuff used and should be readily determinable by those of ordinary sill in the art.

The fabric will stay in the dyebath for a period of time that will also depend on the dyestuff and will be readily determinable by those of ordinary skill in the art. Typical times range from about 30 to about 120 minutes.

After the dyeing step is complete and the fabric or yarn is dyed to the desired shade, typical, optional, subsequent steps may be used. For example, after scouring may be used if desired for a particular result.

Surprisingly, it was discovered that the dyed fabric exhibits a unique chambray appearance without any subsequent process steps (e.g., stone-washing) that are often used to enhance a chambray effect. Surprisingly, the aramid fiber is dyed but the melamine fiber is not (it could be stained) and the fabric exhibits a chambray appearance without further process steps.

Another related aspect of the present invention is a melamine/aramid fiber blend fabric. This fabric may be made according to the above process, and will exhibit a chambray appearance due to the dyeing of the aramid fiber but not the melamine fiber to any significant degree.

V. IMPROVED COMFORT MELAMINE FABRICS AND YARNS

Another feature of the present invention is a process for improving the comfort of fabrics made from melamine fibers. As noted, these fabrics may have a harsh hand. It was very surprising that this hand can be significantly improved by certain dyeing or mock dyeing conditions. This aspect of the invention is illustrated in Examples 9A–D and 10. The increased comfort was especially surprising because it was thought that dyeing makes the hand of dyed fabrics less desirable.

The process involves submerging melamine or melamine blend fabrics in an aqueous bath heated to more than about 70° C. for more than about 15 minutes. The bath may be pure water or it may be a mock dyebath or a dyebath. A mock dye bath may (but does not have to) contain leveling, dispersing, lubricating, chelating or pH adjustment agents. In other words, the mock dyebath may contain all of the chemicals present in a dyebath, except the dyestuffs. The dyebath may contain all of the usual chemicals present in a dyebath. It is not believed, however, that the specific amount and specific type of additives in the dyebath is essential to the result.

The melamine fabric or yarn may be a blend of melamine with one or more m-aramid fibers, p-aramid fibers, glass fibers, carbon fibers, other mineral or ceramic fibers, steel fibers, polybenzimidazole fibers, polyimide fibers, polyamide-imide fibers, polytetraflouroethylene fibers, polyaryletherketone fibers, novoloid fibers, polyetherether ketone fibers, polyacrylate fibers; polyehersulfone fibers, poly(vinyl chloride), poly(vinylidene chloride) fibers, polyvinyl alcohol fibers, nylon, polyester, liquid crystalline polyester fibers, natural and synthetic cellulosic fibers such as cotton fibers, rayon fibers, bast fibers, leaf fibers, cellulose acetate fibers, FR versions of these fibers, wool fibers (and other animal fibers), polyester fibers, modacrylic fibers, acrylic fibers, and various blends and combinations of the above. The melanine may be present at from about 20% to nearly 100% by weight of the fabric or yarn. In the case of fiber blends containing cotton fibers that probably will not later be treated with a flame retardant chemical, the melamine fiber is preferably present at a level of at least about 60% by weight.

It is preferred that the bath be heated to from about 90° C. to about 130° C. for at least about 60 minutes.

Moisture regain is one factor attributed to comfort in fabrics. The moisture regain after such treatment will be greater than about 6.5% based on the weight of the melamine fiber in the fabric or yarn. Preferably, the regain after treatment will be at least about 8% to about 9% based on the weight of the melamine fiber.

In addition to increasing the moisture regain of the melamine fabrics, the process of the present invention also increases the softness of the hand and the whiteness of uncolored melamine fabrics.

This invention will be described by reference to the following detailed examples. The examples are set forth by way of illustration, and are not intended to limit the scope of the invention. All percentages are by weight unless otherwise indicated.

EXAMPLES 1A–1D p-Aramid/Melamine Fiber Blend Fabrics and Yarns—Chambray Appearance

Fabric samples of 60% Basofil® melamine fiber (available from BASF Corporation, Mt. Olive, N.J.) and 40% p-aramid fiber (Twaron® available from Akzo Nobel, Chicago, Ill.) constructed into an 8 oz/yd$^2$ plain weave fabric suitable for firefighter outer shell turn-out gear are scoured by the following procedure and then used for the dyeings of Examples 1A–1D.

Scouring

The scouring step uses a 30:1 (bath:fabric) ratio. The bath contains:

demineralized water;

1.0 gram per liter Sandopan® LF nonionic polyalkylene oxide adduct (available from Clariant Corporation, Charlotte, N.C.); and 0.5 grams per liter soda ash.

The bath containing the fabric is heated to 70° C. and held at 70° C. for 20 minutes.

Samples are then rinsed thoroughly in warm water followed by cold water.

EXAMPLE 1A

Dyeing with Direct Dye

The scoured fabric is dyed in a dyebath at a ratio of 20:1 (dyebath:fabric) with a direct dye. The dyebath contains:

demineralized water;

1.0% Sandopan® LF; and 1.0% Intralite® Red 6BLL (C.I. Direct Red 79) (available from Crompton & Knowles Corporation, Charlotte, N.C.)

The bath pH is adjusted to 3.0 with acetic acid. The bath is heated at 1.5° C. per minute to 135° C. and run at 135° C. for 60 minutes. The bath is cooled and samples are rinsed thoroughly with warm and then cold water. After rinsing, the sample is centrifugally extracted and hung on a line to dry.

EXAMPLE 1B

Dyeine with Non-Metallized Acid Dye

The scoured fabric is dyed in a dyebath at a ratio of 20:1 (dyebath:fabric) with a non-metallized acid dye. The dyebath contains:

demineralized water;

1.0% Chemcogen® AC anionic leveling agent (available from Rhone-Poulenc, Inc., Lawrenceville, Ga., under the trade name Supralev AC); and 1.0% Tectilon® Blue 4R (C.I. Acid Blue 277) (available from Ciba Corporation, Greensboro, N.C.).

The bath pH is adjusted to 3.0 with acetic acid. The bath is heated at 1.5° C. per minute to 135° C. and run at 135° C. for 60 minutes. The bath is cooled and samples are rinsed thoroughly with warm and then cold water. The rinsed sample is centrifugally extracted and hung on a line to dry.

EXAMPLE 1C

Dyeing with Metallized Acid Dye

The scoured fabric is dyed in a dyebath at a ratio of 20:1 (dyebath:fabric) with a metallized acid dye. The dyebath contains:

demineralized water;

1.0% Uniperol®0 leveling agent (available from BASF Corporation, Charlotte, N.C.); and 1.0% Irgalan® Blue 3GL 200% (C.I. Acid Blue 171) (available from Crompton & Knowles Corporation, Charlotte, N.C.)

The bath pH is adjusted to 3.0 with acetic acid. The bath is heated at 1.5° C. per minute to 135° C. and run at 135° C. for 60 minutes. The bath is cooled and samples are rinsed thoroughly with warm and then cold water. The sample is centrifugally extracted and hung on a line to dry.

EXAMPLE 1D

Dyeing with Disperse Dye

The scoured fabric is dyed in a dyebath at a ratio of 20:1 (dyebath:fabric) with a disperse dye. The dyebath contains:

demineralized water; and 1.0% Dipersol® Blue BG Grains (C.I. Disperse Blue 26)(available from BASF Corporation, Charlotte N.C.).

The bath pH is adjusted to 4.5 with acetic acid. The bath is heated at 1.5° C. per minute to 135° C. and run at 135° C. for 60 minutes. The bath is cooled and samples are rinsed thoroughly with warm and then cold water. The rinsed sample is centrifugally extracted and hung on a line to dry.

The melamine fibers in the fabrics are dyed in Examples 1A–1D while the aramid fibers are not dyed to a significant degree. The fabrics exhibit a pleasing chambray appearance and the hand is softer than before the dyeing procedure.

EXAMPLES 2A AND 2B

Producer-Colored p-Aramid/Melamine Fiber Blend Fabrics and Yarns

Fabric samples of 40% of Basofil® melamine fiber and 60% black producer colored Kevlar® fiber (p-aramid fiber available from I.E. Du Pont de Nemours, Wiligton, Del.) constructed in a fashion suitable for firefighter outer shell turn-out gear are scoured by the following and dyed as follows.

Scouring

The scouring bath ratio is 15:1 (bath:fabric). The bath contains:

demineralized water;

0.50% Kieralon® NB-OL anionic scouring agent (available from BASF Corporation, Charlotte, N.C.); and 0.50% soda ash.

The bath is heated to 75° C. and held at 75° C. for 20 minutes. The scoured fabrics are rinsed thoroughly in warm and then cold water.

EXAMPLE 2A

Dyeing with Metallized Acid Dye

The scoured fabrics are dyed at a 15:1 (bath:fabric) ratio in a dyebath containing:

demineralized water;

1.0% Uniperol® NB-SE;

1.5 grams per liter of sodium acetate; and 0.6% Acidol® Black M-SRL dyestuff (C.I. Acid Black 194) (available from BASF Corporation, Charlotte, N.C.).

The bath pH is adjusted to 3.0 with acetic acid. The bath is heated at 1.5° C. per minute to 140° C. and run at 140° C. for 60 minutes. The bath is cooled and samples are rinsed thoroughly with warm and then cold water. The sample is centrifugally extacted and tumble dried.

EXAMPLE 2B

Dyeine with Metallized Acid Dye

A scoured fabric is dyed as in Example 2A, except that the dyestuff is 0.6% Acidol® Grey M-G (C.I. Acid Black 187) (available from BASF Corporation, Charlotte N.C.).

The dyed fabrics of Examples 2A and 2B have a uniform black appearance. Also, the hand of the fabrics is softer after the dyeing process than before.

EXAMPLES 3A AND 3B m-Aramid/Melamine Fiber Blend Fabrics and Yarns—Chambray Appearance Fabrics of 40% of Basofil® melamine fiber and 60% Nomex® 450 fiber (m-aramid available from I.E. Du Pont de Nemours, Wilmington, Del.) is constructed from as an 8 oz/yd$^2$ interlock knit fabric suitable for hood garments such as used by automobile race drivers or firefighters. These fabrics are scoured by the following procedure and dyed as described for Examples 3A and 3B.

Scouring

The fabrics are scoured in a 20:1 (bath:fabric) ratio in a bath containing:

demineraid water;

0.50 grams per liter Kieralon® NB-OL; and 0.50 grams per liter TSPP (tetrasodium pyrophosphate).

The bath is heated to 75° C. and held at 75° C. for 20 minutes. The fabrics are rinsed thoroughly in warm and then cold water.

EXAMPLE 3A

Dyeing with Metallized Acid Dye

The scoured fabrics are dyed at a ratio of 10:1 (bath:fabric) in a bath containing:

demineralize water;

2.0% Uniperol® NB-SE;

1.3 grams per liter sodium acetate; and 1.0% Lanaset Blue 2R dyestuff (available from Ciba Textile Products Corporation, Greensboro, N.C.).

The bath pH is adjusted to 3.0 with citric acid. The bath is heated at 1.5° C. per minute to 130° C. and run at 130° C. for 60 minutes. The bath is cooled and samples are rinsed thoroughly with warm and then cold water. The sample is afterscoured by the following method.

Afterscouring

The afterscouring procedure is at a ratio of 10:1 (bath:fabric) in a bath containing:

demineralized water; and 1.0 gram per liter Tanapon X-70 modified polyglycol ether (available from Sybron Chemicals Inc., Welford, S.C.).

The bath pH is adjusted to 4.5 with acetic acid, heated to 85° C. and run at 85° C. for 20 minutes. The bath is then cooled and samples are rinsed thoroughly with warm and then cold water. The sample is centrifugal extracted and tumble dried.

EXAMPLE 3B

Dyeing with Metallized Acid Dye

Another sample scoured and dyed by the procedures outlined in Example 3A, except that the dyestuff is 1.0% Acidol Black M-SRL.

The melamine fibers are dyed in Examples 3A–3B. The fabrics exhibit a pleasing chambray appearance and softer hand than before the dyeing process.

EXAMPLES 4A–4C m-Aramid/Melamine Fiber Blend Fabrics—Chambray Appearance

Fabrics of 50% of Basofil® melamine fiber and 50% Nomex® 462 (m-aramid available from I.E. Du Pont, Wilmington, Del.) are constructed as a 4.5 oz/yd$^2$ plain weave fabric suitable for protective workwear apparel applications. Samples of this fabric are scoured and dyed as outlined below.

Scouring

The scouring is at a 10:1 (bath:fabric) ratio in a bath containing:

demineralized water;

0.50 grams per liter Kieralon® NB-OL; and 0.50 grams per liter soda ash.

The bath is heated to 75° C. and held at 75° C. for 20 minutes. Samples are rinsed thoroughly in warm and then cold water.

EXAMPLE 4A

Dyeing with Metallized Acid Dye

A fabric sample is dyed at a 15:1 (bath:fabric) ratio in a dyebath containing:

demineralized water;

3.0% Tanapal® BP leveling agent (available from Sybron Chemicals, Wellford, S.C.);

10.5% Lanaset® Grey G 50% dyestuff (no C.I. number) (available from Ciba Corporation, Greensboro, N.C.); and 1.68% Lanaset® Red G dyestuff (no C.I. number) (available from Ciba Corporation, Greensboro, N.C.).

The bath pH is adjusted to 2.5 with citric acid. The bath is heated at 1.5° C. per minute to 135° C. and run at 135° C. for 60 minutes. The bath is cooled and samples are rinsed thoroughly with warm and cold water. The samples are afterscoured by the following method:

Afterscouring

The afterscouring bath contains the fabric at a 10:1 (bath:fabric) ratio. The bath composition is:

demineralized water; and 1.0 gram per liter Tanapon® X-70.

The bath pH is adjusted to 4.5 with acetic acid. The bath is heated to 75° C. and run at 75° C. for 20 minutes. The bath is cooled and samples are rinsed thoroughly with warm and cold water. The samples are centrifugally extracted and tumble dried.

EXAMPLE 4B

Dyeing with Metallized Acid Dye

Another sample is scoured, dyed and afterscoured by the procedures outlined for Example 4A except that the dyestuff is 8.0% Acidol® Black M-SRL.

EXAMPLE 4C

Dyeing with Metallized Acid Dye

Another sample is scoured, dyed and afterscoured by the procedures outlined in Example 4A except that the dyestuff is 8.0% Lanaset® Black B (no C.I. number) (available from Ciba Corporation, Greensboro, N.C.).

The melamine fiber is dyed in Examples 4A–4C while the aramid fiber does not dye to any significant degree. The fabrics exhibit a pleasing chambray appearance and have a softer hand than before dyeing.

EXAMPLES 5A–5B m-Aramid/Melamine Fiber Blend Yarns—Chambray Appearance 30s singles cotton count ring spun yarn of 50% Basofil® melamine fiber and 50% Nomex® 462 m-aramid fiber is circular knit into tubes and scoured and dyed as below.

Scouring

Scouring is at a 15:1 (bath:fabric) ratio in a bath containing:

demineralized water;

0.50 grams per liter Kieralon NB-OL; and 0.50 grams per liter soda ash.

The bath is heated to 75° C. and held at 75° C. for 20 minutes. The scoured samples are rinsed thoroughly in warm and cold water.

EXAMPLE 5A

Dyeing with Disperse Dye demineralized water;

1.0% Palegal® NB-SF dyeing auxiliary for high temperature dyeing (available from BASF Corporation, Charlotte, N.C.);

0.25 grams per liter Versene®D ethylenediaminetetraacetic acid tetrasodium salt chelating agent; and 4.0% Palanil® Blue R (C.I. Disperse Blue 56).

The bath pH is adjusted to 6.0 with acetic acid. The bath is heated at 2.0° C. per minute to 140° C. and run at 140° C. for 60 minutes. The bath is cooled and samples are rinsed thoroughly with warm and cold water. The sample is then centrifugally extracted and tumble dried.

EXAMPLE 5B

Dyeing with Metallized Acid Dye

Another sample is scoured by the procedures outlined for Example 5A and dyed in at a 15:1 (bath:fabric) ratio in a bath containing:

demineralized water;

3.0% Tanapal® BP leveling agent (commercially available from Sybron Chemicals Inc., Welford, S.C.); and 4.0% Lanaset® Black B dyestuff.

The bath pH is adjusted to 2.5 with citric acid. The bath is heated at 2.0° C. per minute to 140° C. and run at 140° C. for 60 minutes. The bath is cooled and samples are rinsed thoroughly with warm and cold water. The sample is then centrifugally extracted and tumble dried.

The melamine fiber is dyed in Examples 5A and 5B while the aramid fiber does not dye to a significant degree. The fabrics exhibit a pleasing chambray effect and have a softer hand than before dyeing.

EXAMPLES 6A AND 6B

Wool/Melamine Fiber Blend Fabrics and Yarns

Fabric samples are prepared in a plain weave construction to give a 9 oz./yd.$^2$ fabric containing (1) 60% Basofil® melamine fiber and 40% wool; or (2) 50% Basofil® melamine fiber and 50% wool; and (3) 40% Basofil® melamine fiber and 60% wool. Fabric samples are dyed as described below:

EXAMPLE 6A

Dyeing with Disperse Dye

The fabrics are each dyed in a bath at a 25:1 (bath:fabric) ratio in a bath containing:

demineralized water;

1.5% Palegal® NB-SF;

0.25 grams per liter Versene®;

3.0% ammonium sulfate; and 4.0% Terasil® Brilliant Blue BGE (C.I. Disperse Blue 60) (available from Ciba Corporation, Greensboro, N.C.).

The bath pH is adjusted to 6.0 with acetic acid. The bath is heated at 2.0° C. per minute to 110° C. and run at 110° C. for 45 minutes. The bath is cooled and samples are rinsed thoroughly with warm and cold water. Each fabric sample is then centrifugally extracted and line dried.

EXAMPLE 6B

Dyeing with Disperse Dye

Each sample is dyed as in Example 6A except that the dyestuff is 1.5% Palanil® Red FFN (C.I. Disperse Red 279) (available from BASF Corporation, Charlotte, N.C.).

The melamine fibers are dyed in Examples 6A and 6B while the wool fibers do not dye to a significant degree. The melamine/wool blend fabrics exhibit a pleasing chambray appearance and have a softer hand than before dyeing.

EXAMPLES 7A–7F

Cellulosic/Melamine Fiber Blend Yarns and Fabrics (Cellulose Dyed) (Chambray Appearance)

A 12 singles cotton count two-ply yarn sample is prepared consisting of 60% of Basofil® melamine fiber and 40% cotton. The yarn is circular knit into tubes or woven into a plain weave 10 oz/yd$^2$ and prepared and dyed as described below:

EXAMPLE 7A

Cotton/Melamine Fiber Blend Dyed With Indigo Dye

Scouring

The circular knit yarn is scoured in a 20:1 (bath:fabric) ratio in a bath containing:

demineralized water;

10.0% sodium hydroxide (50%); and 4 grams per liter Kieralon® NB-CD pretreatment chemical (available from BASF Corporation, Charlotte, N.C.).

The bath is heated to 100° C. and held at 100° C. for 3 hours. Samples are rinsed thoroughly in both hot and cold water.

Bleaching

Scoured knit yarn samples are bleached in a 10:1 (bath:fabric) ratio in a bath containing:

demineralized water;

2.0% Kieralon® NB-CD;

2.0% Prestogen TX-180 peroxide bleaching stabilizer (available from BASF Corporation, Charlotte, N.C.);

5.0% sodium hydroxide (50%); and 10.0% hydrogen peroxide (30%).

The bath is heated to 95° C. and held at 95° C. for 1 hour. The bath is cooled to approximately 50° C., dropped and a fresh bath is made as follows. The bath ratio is 10:1 (bath:fabric).

demineralized water at 60° C.; and 1.0% Lufibrol® NB-7 extracting and dispersing agent for impurities in cotton pretreatments (available from BASF Corporation, Charlotte, N.C.).

The second bath is heated to 65° C. and held at 65° C. for 10 minutes. The bath is cooled to approximately 50° C., dropped and a third fresh bath is made and samples treated at a 10:1 (bath:fabric) ratio in demineralized water. The water bath is heated to 82° C. and held at 82° C. for 10 minutes. The bath is cooled to approximately 50° C., dropped and the samples rinsed with hot water for approximately 10 minutes. The samples are neutralized for 5 minutes in a fresh bath, at approximately a 30:1 (bath:fabric) ratio. The pH is adjusted to 7.0 with acetic acid. The samples are then mercerized as follows:

Mercerizing

The bleached fabric is mercerized at a 20:1 (bath:fabric) ratio in a bath containing:

demineralized water; and 40.0% sodium hydroxide (50%).

The samples are placed in the bath and stirred for 30 seconds. The samples are rinsed with deionized water twice at room temperature at a 30:1 (bath:fabric) ratio. Samples are introduced to another deionized water bath at a 30:1 (bath:fabric) ratio. The pH off the new bath is adjusted to pH 6–7 with acetic acid. The samples are treated in the bath for 5 minutes. Samples are then rinsed in hot and cold water, centrifugally extracted and line dried.

Simulated Continuous Dyeing

To 500 cc of demineralized water at 35° C. is added;

0.5 grams per liter Albatex® OR (leveling and penetrating agent for vat dyes available from Ciba Corporation, Greensboro, N.C.);

15 grams per liter Sodium Hydroxide (50%);

6 grams per liter Indigo Pure (C.I. Vat Blue 1) (available from BASF Corporation, Charlotte, N.C.);

10 grams per liter sodium hydrosulfite; and 1 gram per liter Triton® X-100 (nonionic surfactant available from Rohm and Haas Company, Philadelphia, Pa.).

The fabric is dipped into the solution for 3–5 seconds and squeezed between rolls of a horizontal pad to achieve a wet pick up of approximately 100%. The sample is allowed to stand in air (oxidize) for 60 seconds. The padding and oxidation are repeated 5 more times. The sample is hand washed in warm water for 5 minutes in a bath containing 1 gram per liter Tanapon® X-70. the samples are rinsed thoroughly in warm and cold water, centrifugally extracted and tumble dried.

EXAMPLE 7B

Cotton/Melamine Fiber Blend Dyed with Vat Dye

Circular knit tubes are scoured, bleached and mercerized by the procedures outlined in Example 7A. The dyeing procedure is as follows;

Exhaust Dyeing

The bath ratio is 20:1. The bath contains:

demineralized water at 55° C.;

0.5 grams per liter Albatex® OR;

15 gams per liter sodium hydroxide (50%)

7.5 grams per liter sodium hydrosulfite; and 2.5% Palanthrene® Brilliant Green FFB (C.I. Vat Green 1) (available from BASF Corporation, Charlotte, N.C.).

The bath is stirred for 5 minutes before adding the fabric sample. After adding the fabric, the bath is heated to 60° C. and held at 60° C. for 1 hour. The samples are rinsed thoroughly in warm water. The samples are aftertreated in a 30:1 (bath:fabric) ratio as follows;

demineralized water; and 1 gram per liter sodium perborate.

The aftertreatment bath is heated to 45° C. and run at 45° C. for 20 minutes. The samples are then rinsed thoroughly with warm water and treated 5 minutes in a bath of demineralized water to which 5 grams per liter acetic acid is added. The sample is rinsed thoroughly with cold water, centrifugally extracted and tumble dried.

EXAMPLE 7C

Cotton/Melamine Fiber Blends Dyed with Vat Dye

Circular knit tubes are scoured, bleached and mercerized by the procedures outlined in Example 7A. The samples are dyed by the procedures outlined in Example 7B, except that the dyestuff is 0.2% Palanthrene® Brown LBG (C.I. Vat Brown 84) (available from BASF Corporation, Charlotte, N.C.

EXAMPLE 7D

Dyeing of Cotton/Melamine Fiber Blend with Direct Dye

Circular knit tubes or woven fabric from Example 6 are scoured, bleached and mercerized by the procedures outlined in Example 7A except that the dyeing is done as follows;

Dyeing

The fabric is dyed at a 20:1 (bath:fabric) ratio. The bath contains:

demineralized water;

1.0% Intratex® DD leveling agent (available from Crompton & Knowles Colors, Inc., Charlotte, N.C.);

20% Glauber's salt (sodium sulfate);

0.4% Intralite® Brilliant Blue L (C.I. Direct Blue 98) (available from Crompton & Knowles Colors, Inc., Charlotte, N.C.); and 4.0% Superlitefast® Yellow EFC (C.I. Direct Yellow 106) (available from Crompton & Knowles Colors, Inc., Charlotte, N.C.).

The bath pH is adjusted to 6.0 with acetic acid. The bath is heated to 95° C. and held at 95° C. for 1 hour. Samples are rinsed thoroughly in warm and cold water, centrifugally extracted and tumble dried.

EXAMPLE 7E

Cotton/Melamine Fiber Blend Dyed with Direct Dye

Circular knit tubes are scoured, bleached and mercerized by the procedures outlined in Example 7A, dyed as in Example 7D, except that the following dyestuffs are used:

2.48% Intralite® Brilliant Blue L (C.I. Direct Blue 98) (available from Crompton & Knowles Colors, Inc., Charlotte, N.C.);

0.27% Intralite® Scarlet BNLL (C.I. Direct Red 89) (available from Crompton & Knowles Colors, Inc., Charlotte, N.C.);

1.13% Superlitefast® Yellow EFC (C.I. Direct Yellow 106) (available from Crompton & Knowles Colors, Inc., Charlotte, N.C.).

EXAMPLE 7F

Cotton/Melamine Fiber Blend Dyed with Naphthol Dye

Circular knit tubes are scoured, bleached and mercerized by the procedures outlined in Example 7A and dyed as follows Dyeing—Impregnation Fabrics are treated at a 10:1 (bath:fabric) ratio in a bath containing:

demineralized water;

2.0 grams per liter Patogen Stabilizer NDA dyebath stabilizer (available from Yorkshire Pat-Chem Inc., Greenville, S.C.);

8.0 grams per liter Naphtanilide® SG 50% Liq. (C.I. Azoic Coupler 13) (available from Yorkshire Pat-Chem Inc., Greenville, S.C.); and 7.0 grams per liter sodium hydroxide (50%)

The sample is tumbled in the bath for 40 minutes at room temperature, removed and centrifugally extracted.

Dyeing—Development

The fabrics are then dyed at a 10:1 (bath:fabric) ratio in a bath containing:, demineralized water;

0.72 grams per liter Pat-Wet® Diazosperse dispersing agent (available from Yorkshire Pat-Chem Inc., Greenville, S.C.); and 9.0 grams per liter Diazo Fast Red B (C.I. Diazo Component 5) (available from Yorkshire Pat-Chem Inc., Greenville, S.C.).

The sample is tumbled in the bath for 40 minutes at room temperature, removed and rinsed warm and cold. The sample is then soaped by the following procedure:

Soaping

The soaping is at a 10:1 (bath:fabric) ratio. The soaping bath contains:

demineralized water;

1.0 gram per liter soda ash; and 0.5 grams per liter Kieralon® TX-199 nonionic scouring agent (available from BASF Corporation, Charlotte, N.C.).

The samples are heated to 60° C. and run at 60° C. for 10 minutes. The samples are then placed in a fresh soaping bath with 2.0 grams per liter soda ash and 0.5 grams per liter Kieralon® TX-199. The samples are heated to 90° C. and run at 90° C. for 20 more minutes. Samples are finally rinsed thoroughly in hot, warm and cold water, centrifugally extracted and tumble dried. (Naphtanilide® SG 50% and Fast Red B are commercially available from Yorkshire Pat-Chem Inc., Greenville, S.C.)

In Examples 7A–7F, the cotton fiber is dyed while the melamine fiber is not substantially colored. The fabrics have a pleasing chambray appearance.

EXAMPLE 8A–8D

Cellulosic/Melamine Fiber Blend Yarns and Fabrics (Melamine Dyed) (Chambray Appearance)

Circular knit tubes as described in Example 7 are scoured, bleached and mercerized by the procedures outlined in Example 7. The tubes are then dyed by the following procedures;

EXAMPLE 8A

Cotton/Melamine Fiber Blend Dyed with Disperse Dye

The sample is dyed at a 15:1 (bath:fabric) ratio in a bath containing:

demineralized water;

1.0% Palegal® NB-SF;

0.25% Versene; and 2.0% Terasil® Blue R.

The bath pH is adjusted to 5.0 with acetic acid. The bath is heated at 2.0° C. per minute to 140° C. and run at 140° C. for 60 minutes. The bath is cooled and samples are rinsed thoroughly with warm and cold water. The sample is then centrifugally extracted and tumble dried.

EXAMPLE 8B

Cotton/Melamine Blend Dyed with Disperse Dye

Circular knit tubes or woven fabric from Example 7 which are not scoured, bleached and mercerized are dyed by the procedure outlined in Example 8A after the following scour:

Scour

Samples are scoured at a 15:1 (bath:fabric) ratio in a bath containing:

demineralized water;

1.0% Kieralon® NB-OL; and 1.0% trisodium phosphate.

The bath is heated to 75° C. and run at 75° C. for 20 minutes. Following the scour, the samples are rinsed thoroughly with warm and cold water.

EXAMPLE 8C

Cotton/Melamine Fiber Blends Dyed with Metallized Acid Dye

Circular knit tubes or woven fabric from Example 7 which are scoured, bleached and mercerized by the procedures outlined in Example 7A are dyed by the following procedure:

Dyeing

The samples are dyed at a 15:1 (bath:fabric) ratio in a bath containing:

demineralized water;

2.0% Uniperol NB-SE;

1.5 grams per liter sodium acetate; and 2.0% Acidol® D Black M-SRL.

The bath pH is adjusted to 3.0 with citric acid. The bath is heated at 2.0° C. per minute to 140° C. and run at 140° C. for 60 minutes. The bath is cooled and samples are rinsed thoroughly with warm and cold water. The sample is then centrifugally extracted and tumble dried.

EXAMPLE 8D

Cotton/Melamine Fiber Blend Dyed with Metallized Acid Dye

Circular knit tubes or woven fabric from Example 7 which are not scoured, bleached and mercerized are dyed by the procedure outlined in Example 8C after the scouring procedure outlined in Example 8B. In Examples 8A–8D, the melamine fiber is dyed while the cotton fiber did not dye to a significant degree. The samples have a pleasing chambray appearance.

EXAMPLES 9A—9D

Mock-Dyeing Melamine Yarns and Fabrics

Samples of an 18 oz/yd$^2$ plain weave fabric consisting of 100% by weight of Basofil® melamine fiber is scoured by the following procedure and mock-dyed in a bath containing dyeing auxiliaries but not dyestuff by various simulated dyeing conditions outlined below. Fabric hand and flexural rigidity are assessed and reported in TABLES 1 and 2 using also a scoured sample as Example 9.

Scouring (Example 9)

Samples are scoured at a 15:1 (bath:fabric) ratio in a bath containing:

demineralized water;

0.50 grams per liter Kieralon NB-OL; and 0.50 grams per liter soda ash;

The bath is heated to 70° C. and held at 70° C. for 20 minutes. Samples are rinsed thoroughly in warm and cold water.

EXAMPLE 9A

Simulated Melamine/Aramid Fiber Blend Dyeing

The fabric is mock-dyed at a 5:1 (bath:fabric) ratio in a bath containing;

demineralized water at 60° C.;

2.0% Uniperol® W dispersing and leveling agent (available from BASF Corporation, Charlotte, N.C.);

30 grams per liter Cindye® C-45 aryl ether dyeing assistant (available from Stockhausen Inc., Greensboro, N.C.); and 15 grams per liter sodium nitrate.

The bath pH is adjusted to 2.5 with citric acid. The bath is heated at 1.5° C. per minute to 135° C. and run at 135° C. for 20 minutes. The bath is emptied at 70° C. and the sample is rinsed with hot and cold water.

EXAMPLE 9B

Simulated Melamine/Aramid Fiber Blend Dyeing

Scoured fabric samples are dyed by the procedures outlined in Example 9A, except the time the dyebath is held at 135° C. is 60 minutes.

EXAMPLE 9C

Simulated Melamine/Cellulosic Fiber Blend Dyeing

Scoured fabric samples are mock-dyed at a 15:1 (bath:fabric) ratio in a bath containing:

demineralized water;

1.0% Intratex® DD; and

20% Glauber's Salt.

The pH is not adjusted. The bath is heated at approximately 3.0° C. per minute to 90° C. and run at 90° C. for 20 minutes. The bath is cooled, emptied and the sample is rinsed with hot and cold water.

EXAMPLE 9D

Simulated Melamine/Cellulosic Fiber Blend Dyeing

Scoured fabric samples are dyed by the procedures outlined in Example 9C, except the time the dyebath is held at 90° C. is 60 minutes.

The mock-dyed fabric samples of Examples 9A–9D and a scoured sample of Example 9 are evaluated against an untreated fabric sample (100% melamine) as a control for characteristics which are believed to contribute to increased comfort. These characteristics are fabric hand by *AATCC Evaluation Procedure* 5; flexural rigidity by *ASTM Method D*-1388-64; and moisture regain by *AATCC Test Method* 20*A*-1981. TABLE 1 illustrates the results from *AATCC Procedure* 5-*Fabric Hand: Subjective Evaluation of Fabrics*. In this procedure, five observers rate the fabric samples with respect to stiffness, pliability, softness, scratchiness and overall appeal compared to the untreated control. The samples are coded so that the observers cannot identify the control. Observers sit in a room conditioned at 65+/−2% relative humidity and 70+/−2 degrees Fahrenheit to evaluate each treated sample against the untreated control. The samples are evaluated first on a flat surface, and then by handling between the thumb and finger tips. Ratings are reported based on the scale presented in TABLE 1. All observers rated all treated samples 9A–9D as less stiff, more pliable, softer and less scratchy than the untreated control.

TABLE 1

Assessment of Hand for Treated Fabrics Averages from 5 Observers

| Example | Treatment | Less Stiff | More Pliable | Softer | Less Scratchy | Overall |
|---|---|---|---|---|---|---|
| 9 | 1 | 2.6 | 2.6 | 1.6 | 1.6 | 1.8 |
| 9A | 2 | 3.4 | 3.2 | 3.0 | 3.0 | 2.8 |
| 9B | 3 | 3.4 | 3.2 | 3.4 | 3.6 | 3.6 |
| 9C | 4 | 2.8 | 3.4 | 2.8 | 3.0 | 3.0 |
| 9D | 5 | 3.4 | 2.8 | 3.8 | 3.4 | 3.0 |

Treatments:
1 = Scoured
2 = Mock Dyed, pH 2.5 20 minutes, 135° C.
3 = Mock Dyed, pH 2.5, 60 minutes, 135° C.
4 = Mock Dyed, 20 minutes, 90° C.
5 = Mock Dyed, 60 minutes, 90° C.
Ratings:
1 = No Difference
2 = Slight Difference
3 = Moderate Difference
4 = Extreme Difference The results indicate that fabrics 9A–9D show significant differences in individual and overall hand of from the untreated control fabric.

TABLE 2 illustrates the results from *ASTM Method D*-1388-64 for flexural rigidity. The results show that all mock-dyed fabrics 9A–9D have flexural rigidity values that are about 3–9 times less than untreated control. Flexural rigidity is a measure of resistance to bending or stiffness. Lower flexural rigidity indicates lower resistance to bending or improved "draping" properties.

TABLE 2

Fabric Stiffness Evaluation

| Example | Treatment | Average Overhang Length | Bending Length | Flexural Rigidity (mg-cm) |
|---|---|---|---|---|
| Control | | 6.4 | 3.2 | 2027.753 |
| 9 | 1 | 5.5 | 2.7 | 1255.232 |
| 9A | 2 | 3.2 | 1.6 | 238.404 |
| 9B | 3 | 3.2 | 1.6 | 245.281 |
| 9C | 4 | 4.1 | 2.0 | 514.240 |
| 9D | 5 | 4.1 | 2.1 | 537.319 |

Treatments:
Control = untreated
1 = Scoured
2 = Mock Dyed, pH 2.5, 20 minutes, 135° C.
3 = Mock Dyed, pH 2.5, 60 minutes, 135° C.
4 = Mock Dyed, 20 minutes, 90° C.
5 = Mock Dyed, 60 minutes, 90° C.

TABLE 3 depicts results for moisture regain (as moisture content at 65% RH and 72° F.) as measured by *AATCC Test Method* 20*A*-1981. The results indicate that mock-dyed samples have moisture regain about 2 to about 5 percent higher than untreated samples and the scoured sample of Example 9.

TABLE 3

Moisture Regain of Fabrics

| Example | Treatment | Moisture Regain |
|---|---|---|
| Control | | 6.07 |
| 9 | 1 | 7.5 |
| 9A | 2 | 10.12 |
| 9B | 3 | 9.53 |
| 9C | 4 | 8.67 |
| 9D | 5 | 8.38 |

Treatments:
Control = untreated
1 = Scoured
2 = Mock Dyed, pH 2.5, 20 minutes, 135° C.
3 = Mock Dyed, pH 2.5, 60 minutes, 135° C.
4 = Mock Dyed, 20 minutes, 90° C.
5 = Mock Dyed, 60 minutes, 90° C.

EXAMPLE 10

Mock-Dyed Melamine Fiber Fabric

A woven fabric of 100% Basofil® melamine fibers are mock-dyed according to the following process:

Scouring

The fabric is scoured in a bath to a weight ratio of 10:1 (bath:fabric). The bath contains:

demineralized water;

0.50 grams per liter Kieralon® NB-OL; and 0.50 grams per liter of TSPP.

The fabric is placed in the bath. The bath is heated to 75° C. and held at 75° C. for 20 minutes. The fabric is removed from the bath and rinsed thoroughly in warm and then cold water.

Mock-Dyeing

Following scouring, the fabric is mock-dyed at a weight ratio of 10:1 (bath:fabric). The bath contains:

demineralized water at 50° C.;

3.00% Tanapal® BP leveling agent;

15 grams per liter sodium nitrate; and and 40 grams per liter Cindye® C-45.

The bath pH is adjusted to 2.5 with citric acid.

With the fabric in it, the bath is heated at 1.5° C. per minute to 135° C. and run at 135° C. for 60 minutes. The bath is emptied at 70° C. and the sample is rinsed with hot and then cold water. The sample is then afterscoured.

Afterscouring

The fabric is after scoured in a 10:1 (bath:fabric) ratio. The bath contains:

demineralized water; and 1.0 gram per liter Tanapon® X-70.

The bath pH is adjusted to 4.5 with citric acid.

The bath containing the fabric is heated to 75° C. and run at 75° C. for 20 minutes. The bath is cooled and samples are rinsed thoroughly with warm and then cold water.

Physical Properties

Using a length of yarn taken from as-is fabric and a length of yarn taken from the mock-dyed fabric, the physical properties are measured. Denier is measured according to *ASTM Method D*-1907-89. Breaking load, tenacity, modulus at 3%, modulus at 5%, and breaking elongation, are measured by *ASTM method D*-2256-95*A* with the following results:

| | Untreated Yarn | Mock-dyed yarn |
|---|---|---|
| Denier | 3996 | 5250 |
| Cotton Count | 1.3 | 1.0 |
| Breaking load (gm) | 2204.0 | 2035.0 |
| Tenacity (gpd) | 0.55 | 0.39 |
| Modulus at 3% (gpd) | 9.56 | 4.29 |
| Modulus at 5% (gpd) | 4.55 | 3.02 |
| Breaking elongation (%) | 9.3 | 11.1 |

EXAMPLE 11

Aramid/Melamine Fiber Blend Fabrics (Aramid Dyed) (Chambray Appearance)

EXAMPLE 11A

Dyeing with Basic Dye

A 30s singles cotton count ring spun yarn sample of 50% by weight of Basofil® melamine fiber and 50% Nomex® 462 m-aramid fiber is circular knit into tubes, scoured, dyed and afterscoured as outlined below.

Scouring

The knit tube is scoured in a bath at a weight ratio of 15:1 (bath:fabric). The bath contains:

demineralized water;

0.50 grams per liter Kieralon NB-OL; and 0.50 grams per liter soda ash.

The bath is heated to 75° C. and held at 75° C. for 20 minutes. Samples are rinsed thoroughly in warm and cold water.

The scoured sample is placed into the dye vessel at a 15:1 (bath:fabric) ratio. The bath contains demineralized water at 60° C. Thirty (30) grams per liter Cindye® C-45 is added to the bath. The bath is heated at 1.5° C. per minute to 75° C. and held for 15 minutes at 75° C. 2.0% Uniperol® W is added and the sample is held at 75° C. for 10 minutes. 2.0%

Basacryl® Blue X-3GL (C.I. Basic Blue 41) (available from BASF Corporation, Charlotte, N.C.) is added and the sample is held at 75° C. for 10 minutes. 15 grams per liter Sodium Nitrate is added to the bath and the pH is adjusted to 2.5 with citric acid. The bath is heated at 1.5° C. per minute to 135° C. and run at 135° C. for 60 minutes. The bath is emptied at 70° C. and the sample is rinsed with hot and cold water.

Afterscouring

The dyed knit tube is afterscoured at a 15:1 (bath:fabric) ratio in a bath containing:

demineralized water; and 1.0 gram per liter Tanapon® X-70.

The bath pH is adjusted to 4.5 with acetic acid. The bath is heated to 75° C. and run at 75° C. for 20 minutes. The bath is cooled and samples are rinsed thoroughly with warm and cold water. The sample is then centrifugally extracted and tumble dried.

EXAMPLE 11B

Dyeing with Basic Dye

Another sample is scoured, dyed and afterscoured by the procedures outlined in Example 11A, except the dye is 2.0% Basacryl® Yellow X-2GL (C.I. Basic Yellow 65) (available from BASF Corporation, Charlotte, N.C.).

EXAMPLE 11C

Dyeing with Basic Dye

Another sample is scoured, dyed and afterscoured by the procedures outlined in Example 11A, except the dye is 2.0% Basacryl® Red GL (C.I. Basic Red 29) (available from BASF Corporation, Charlotte, N.C.). In Examples 11A–11C, the aramid fiber is dyed while the melamine fiber is not substantially colored. The fabrics have a pleasing chambray appearance.

What is claimed is:

1. A process for treating a fabric made from melamine fibers to achieve increased moisture regain, comprising the steps of:

(a) providing an aqueous dyestuff-free mock dye bath consisting essentially of water and at least one dyebath solute;

(b) heating the mock dye bath to a temperature greater than 70° C., and (c) submerging the fabric in the heated aqueous mock dye bath for more than 20 minutes to achieve an increased moisture regain of at least about 8% based on the weight of the melamine fibers as measured by AATCC Test Method 20A-1981.

2. The process of claim 1 wherein the aqueous mock dye bath is substantially all water.

3. The process of claim 1 wherein the aqueous mock dye bath contains one or more dye bath solutes selected from the group consisting of:

leveling agents;

dispersing agents;

chelating agents;

lubricating agents;

pH adjustment agents; and combinations thereof.

4. The process of claim 1 wherein the aqueous mock dye bath is heated to a temperature from about 90° C. to about 130° C.

5. The process of claim 1 wherein the fabric is submerged in the bath for at least about 60 minutes.

6. The process of claim 1 wherein the fabric comprises a blend of melamine fibers and other fibers.

7. The process of claim 1 wherein the melamine fibers are melamine-formaldehyde fibers comprising the condensation product of melamine and formaldehyde in a molar ratio of two moles of formaldehyde to one mole melamine and containing hydroxyoxaalkylmelamines and, optionally, other additives in small amounts.

8. A process for treating a fabric made from melamine fibers to achieve increased moisture regain, comprising the steps of:

(a) providing an aqueous dyestuff-free mock dye bath consisting essentially of water and at least one dyebath solute; and (b) submerging the fabric in the aqueous mock dye bath at a temperature and for a time sufficient to achieve an increased moisture regain of greater than about 8% by weight of the melamine fibers in the fabric as measured by AATCC Test Method 20A-1981.

9. The process of claim 8 wherein said blend contains from 20% to nearly 100% by weight of melamine fibers.

10. The process of claim 8 wherein said fabric comprises a blend of melamine fibers and other fibers.

11. The process of claim 10 wherein said other fibers are selected from the group consisting of: m-aranid fibers, p-aramid fibers, glass fibers, carbon fibers, mineral fibers, ceramic fibers, steel fibers, polybenzimidazole fibers, polytetrafluoroethylene fibers, polyaryletherketone fibers, novoloid fibers, polyethersulfone fibers, polyimide fibers, polyamide-imide fibers, polyetherether ketone, polyacrylate fibers, poly(vinyl chloride), poly(vinyl alcohol) fibers, poly (vinylidene chloride) fibers, nylon fibers, liquid crytalline polyester fibers, cotton fibers, rayon fibers, bast fibers, leaf fibers, cellulose acetate fibers, wool, cashmere, rabbit, silk, mohair, acrylic fibers, modacrylic fibrs, FR versions of these fibers, and blends and combinations thereof.

* * * * *